US011780050B2

(12) United States Patent
Cho

(10) Patent No.: US 11,780,050 B2
(45) Date of Patent: Oct. 10, 2023

(54) APPARATUS OF CLEANING A POLISHING PAD AND POLISHING DEVICE

(71) Applicant: SK SILTRON CO., LTD., Gumi-si (KR)

(72) Inventor: Ji Hwan Cho, Gumi-si (KR)

(73) Assignee: SK SILTRON CO., LTD., Gumi-si (KR)

( * ) Notice: Subject to any disclaimer, the term of this patent is extended or adjusted under 35 U.S.C. 154(b) by 61 days.

(21) Appl. No.: 17/199,163

(22) Filed: Mar. 11, 2021

(65) Prior Publication Data

US 2022/0161390 A1 May 26, 2022

(30) Foreign Application Priority Data

Nov. 26, 2020 (KR) ..... 10-2020-0161048

(51) Int. Cl.
*B24B 53/017* (2012.01)
*B24B 53/00* (2006.01)

(52) U.S. Cl.
CPC ..... *B24B 53/017* (2013.01); *B24B 53/003* (2013.01)

(58) Field of Classification Search
None
See application file for complete search history.

(56) References Cited

U.S. PATENT DOCUMENTS 5,616,069 A * 4/1997 Walker ..... B08B 3/02 15/88.1
6,012,968 A * 1/2000 Lofaro ..... B24C 3/22 451/39
6,022,414 A * 2/2000 Miller ..... C23C 16/45572 156/345.33
6,053,801 A * 4/2000 Pinson ..... B08B 17/02 451/444
6,139,406 A * 10/2000 Kennedy ..... B24B 37/04 451/283
6,168,502 B1 * 1/2001 Allman ..... B24B 53/017 451/910
6,220,941 B1 * 4/2001 Fishkin ..... B24B 57/02 451/63
6,284,092 B1 * 9/2001 Manfredi ..... B24B 57/02 451/446
6,443,816 B2 * 9/2002 Inoue ..... B24B 55/02 451/72
6,626,743 B1 * 9/2003 Boyd ..... B24B 21/04 451/299
6,669,538 B2 * 12/2003 Li ..... B24B 53/017 451/60

(Continued)

FOREIGN PATENT DOCUMENTS

JP 2009-542450 A 12/2009
WO WO 2008/002811 A2 1/2008
WO WO 2017/183360 A1 10/2017

OTHER PUBLICATIONS

Japanese Office action dated Apr. 26, 2022 issued in corresponding JP Application No. 2021-054761, 4 pages.

*Primary Examiner* — Don M Anderson
*Assistant Examiner* — Jonathan R Zaworski
(74) *Attorney, Agent, or Firm* — Lewis Roca Rothgerber Christie LLP

(57) ABSTRACT

An apparatus of cleaning a polishing pad includes: a first gas nozzle for spraying gas onto the pores of the polishing pad; and a first liquid nozzle for spraying a liquid to the pores of the polishing pad.

10 Claims, 11 Drawing Sheets

(56) References Cited

U.S. PATENT DOCUMENTS

| | | | | |
|---|---|---|---|---|
| 7,348,276 | B2 * | 3/2008 | Shirasu | B24B 53/017 438/692 |
| 7,455,575 | B2 * | 11/2008 | Kim | B24B 53/017 451/446 |
| 7,559,824 | B2 * | 7/2009 | Park | B24B 53/017 451/443 |
| 9,138,861 | B2 * | 9/2015 | Wu | B24B 53/017 |
| 9,452,506 | B2 * | 9/2016 | Butterfield | B24B 53/017 |
| 9,579,768 | B2 * | 2/2017 | Motoshima | B24B 49/14 |
| 9,630,295 | B2 * | 4/2017 | Peng | B08B 3/02 |
| 9,687,960 | B2 * | 6/2017 | Butterfield | B24B 1/00 |
| 9,833,876 | B2 * | 12/2017 | Chan | B24B 37/34 |
| 10,259,098 | B2 * | 4/2019 | Motoshima | B24B 53/017 |
| 10,350,728 | B2 * | 7/2019 | Diao | B24B 37/04 |
| 10,737,366 | B2 * | 8/2020 | Lee | B24B 53/017 |
| 10,780,548 | B2 * | 9/2020 | Jung | B24B 53/017 |
| 11,094,554 | B2 * | 8/2021 | Lin | B24B 53/017 |
| 2007/0135020 | A1 * | 6/2007 | Nabeya | B24B 37/015 451/7 |
| 2018/0243882 | A1 * | 8/2018 | Lee | B24B 55/06 |
| 2019/0126430 | A1 * | 5/2019 | Shinozaki | B24B 55/06 |

* cited by examiner

APPARATUS OF CLEANING A POLISHING PAD AND POLISHING DEVICE

CROSS-REFERENCE TO RELATED APPLICATION(S)

This application claims priority to Korean Patent Application Number 10-2020-0161048, filed on Nov. 26, 2020, the entire content of which is incorporated herein by reference.

BACKGROUND

The embodiment relates to an apparatus of cleaning a polishing pad and a polishing device.

In general, a wafer, which is widely used as a material for manufacturing semiconductor devices, refers to a single crystal silicon thin plate made of polycrystalline silicon as a raw material.

Such wafers include a slicing process in which polycrystalline silicon is grown into a single crystal silicon ingot, and then the silicon ingot is cut into a wafer shape, a lapping process in which the thickness of the wafer is uniform and flattened, an etching process that removes or mitigates damage caused by mechanical polishing, a polishing process that mirrors the wafer surface, and a cleaning process that cleans the wafer.

In general, the polishing process is a very important process because it is a process of finally making flatness and surface roughness before the wafer enters the device process.

The polishing process includes a double-sided polishing (DSP) process for polishing both sides of a wafer, and a final polishing process (FP) for removing foreign substances on one side of the wafer.

In the final polishing process, the wafer transferred by the carrier rotates while being pressed on the polishing pad, so that the surface of the wafer is mechanically flattened, and at the same time, a slurry that performs a chemical reaction is supplied to the polishing pad. Thus, the surface of the wager allows to be chemically flattened.

Of course, in order to achieve an efficient polishing rate in the polishing process, the surface roughness of the polishing pad must always be kept constant.

However, a polishing pad that repeatedly performs a polishing process loses a polishing function gradually as its surface roughness decreases. To prevent this problem, a cleaning process for optimizing the state of the polishing pad separately is performed.

As shown in FIG. 1, pores 3 are provided on the surface of the polishing pad, and foreign substances 5 or slurry particles are filled in the pores 3.

In the related art, washing water is sprayed from the nozzle 7 to the polishing pad 1. However, since the inlet of the pore 3 is narrow, the washing water is not sprayed into the pore 3. Thus, foreign substance 5 or slurry particles in the pore 3 are not easily removed, resulting in poor cleaning.

In particular, since the nozzle 7 is sprayed vertically with respect to the polishing pad 1 in the related art, foreign substance 5 or slurry particles in the pore 3 are more difficult to remove.

SUMMARY

The embodiment aims to solve the above problems and other problems.

Another object of the embodiment is to provide an apparatus of cleaning a polishing pad and a polishing device capable of improving cleanliness.

Another object of the embodiment is to provide an apparatus of cleaning a polishing pad and polishing device in which wafer contamination is minimized by improving cleanliness.

According to an aspect of the embodiment to achieve the above or other objects, an apparatus of cleaning a polishing pad includes: a first gas nozzle for spraying gas onto the pores of the polishing pad, and a first liquid nozzle for spraying a liquid to the pores of the polishing pad.

According to another aspect of the embodiment, a polishing device includes: a platen; a polishing pad disposed on the platen, a polishing head positioned on the polishing pad, adsorbed to a lower portion of the polishing pad and pressed against the polishing pad; a slurry spray nozzle spraying the slurry onto the polishing pad; and an apparatus of cleaning a polishing pad, wherein the apparatus of cleaning a polishing pad comprising: a first gas nozzle for spraying gas onto the pores of the polishing pad; and a first liquid nozzle for spraying a liquid to the pores of the polishing pad.

The effects of the apparatus of cleaning a polishing pad and the polishing device according to the embodiment will be described as follows.

According to at least one of the embodiments, it is possible to remove foreign substance or slurry remaining in the pores of the polishing pad by using at least one gas nozzle and a liquid nozzle, thereby improving the cleanliness of the polishing pad.

According to at least one of the embodiments, the first liquid nozzle and the second liquid nozzle are disposed in a diagonal direction to face each other, so that the liquid sprayed from each of the first liquid nozzle and the second liquid nozzle collides diagonally into the pores of the polishing pad. Thus, foreign substance or slurry in the pores of the polishing pad can be more completely removed due to collision.

According to at least one of the embodiments, foreign matter or slurry remaining inside the pores of the polishing pad is more completely removed, through the first and second liquid nozzles disposed to have a tilt angle with respect to the polishing pad and a third liquid nozzle disposed perpendicular to the polishing pad between the first and second liquid nozzles. Thus, the cleanliness of the polishing pad can be improved.

Further scope of applicability of the embodiments will become apparent from the detailed description below. However, various changes and modifications within the spirit and scope of the embodiments may be clearly understood by those skilled in the art, and thus specific embodiments such as detailed description and preferred embodiments should be understood as being given by way of example only.

DETAILED DESCRIPTION OF THE EMBODIMENTS

Hereinafter, preferred embodiments of the present invention will be described in detail with reference to the accompanying drawings. However, the technical idea of the present invention is not limited to some embodiments to be described, but may be implemented in various different forms, and within the scope of the technical idea of the present invention, one or more of the components can be selectively combined with and substituted for use. In addition, terms (including technical and scientific terms) used in the embodiments of the present invention are generally understood by those of ordinary skill in the art, unless explicitly defined and described. It can be interpreted as a meaning, and terms generally used, such as terms defined in a dictionary, may be interpreted in consideration of the meaning in the context of the related technology. In addition, terms used in the embodiments of the present invention are for describing the embodiments and are not intended to limit the present invention. In the present invention, the singular form may include the plural form unless specifically stated in the phrase, and when described as "at least one (or more than one) of A, B and (and) C", it is combined with A, B, and C. It may contain one or more of all possible combinations. In addition, terms such as first, second, A, B, (a), and (b) may be used in describing the components of the embodiment of the present invention. These terms are only for distinguishing the component from other components, and are not limited to the nature, order, or order of the component by the term. And, when a component is described as being 'connected', 'combined' or 'coupled' to another component, it can be included that the component is not only directly connected, combined or coupled to the other component, but also the component is indirectly connected, combined or coupled to another element through another element between the other elements. In addition, when it is described as being formed or disposed in the "top (top) or bottom (bottom)" of each component, the top (top) or bottom (bottom) is one as well as when the two components are in direct contact with each other. It includes a case in which the above other component is formed or disposed between the two components. In addition, when expressed as "upper (upper) or lower (lower)", it may include not only an upward direction but also a downward direction based on one component.

Figure 1:
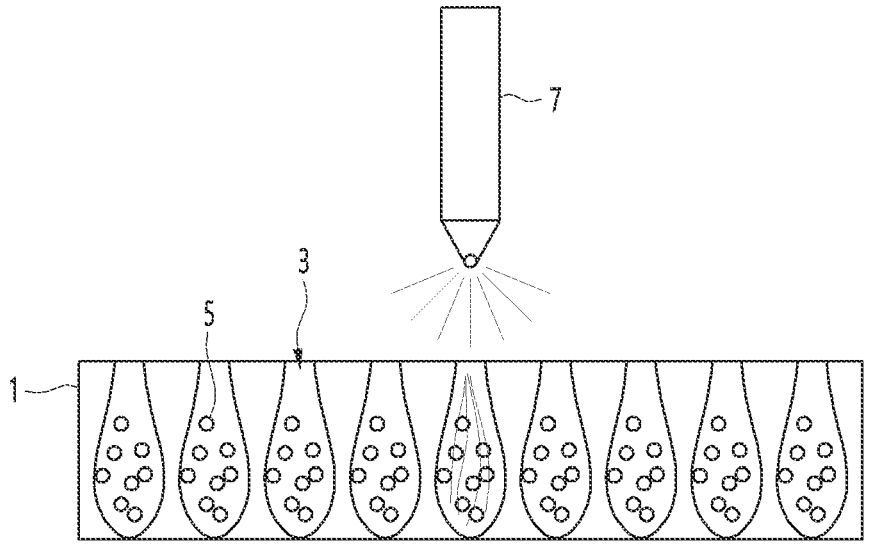
FIG. 1 Related Art
FIG. 1 shows a polishing pad cleaning in the related art.
Figure 2:
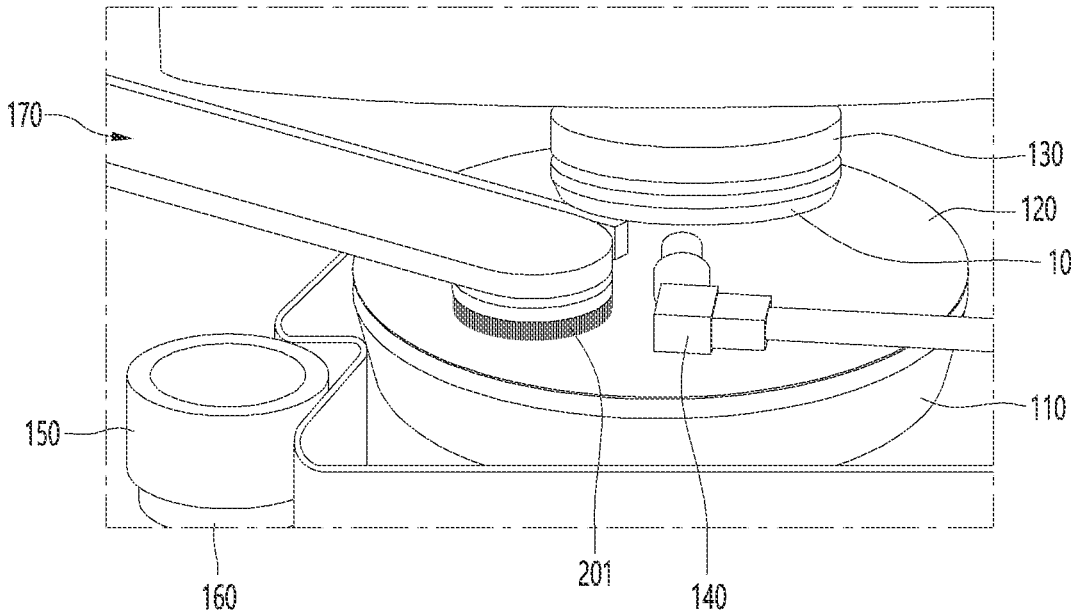
FIG. 2 shows a polishing device according to an embodiment.

FIG. 2 shows a polishing device according to an embodiment.

Referring to FIG. 2, the polishing device 100 according to the embodiment may include a platen 110, a polishing pad 120, a polishing head 130, and a slurry spray nozzle 140.

The platen 110 may be rotatable, but is not limited thereto.

The polishing pad 120 may be attached to the upper side of the platen 110 and rotated by the rotation of the platen 110.

The polishing head 130 is positioned on the polishing pad 120, and the wafer 10 may be adsorbed thereto. For example, the polishing head 130 to which the wafer 10 is adsorbed may move downward to press the polishing pad 120. At this time, by rotating the polishing pad 120 in synchronization with the rotation of the platen 110, the surface of the wafer 10 may be polished and foreign substances (123 in FIG. 4) may be removed. When the polishing pad 120 of the platen 110 is rotated, the slurry is sprayed between the polishing pad 120 and the wafer 10 by the slurry spray nozzle 140, so that the polishing of the wafer 10 can be performed more easily.

The slurry spray nozzle 140 may be located on the side of the polishing head 130 to which the wafer 10 is attached, and may be installed to be movable so as to spray the cleaning liquid over the entire polishing pad 120.

For example, instead of rotating the platen 110, the polishing head 130 may be rotated. For example, both the platen 110 and the polishing head 130 are rotated and they may be rotated in opposite directions.

Meanwhile, as the polishing process is repeated, various foreign substances (123 in FIG. 4) or slurry accumulate on the surface of the polishing pad 120, it is necessary to remove such foreign substances 123 or slurry.

The polishing device 100 according to the embodiment may further include an apparatus of cleaning a polishing pad 170.

The apparatus of cleaning a polishing pad 170 may clean the polishing pad 120 to remove foreign substances 123 or slurry on the surface of the polishing pad 120.

Meanwhile, since the foreign substance 123 or the slurry is buried in the brush 201 of the polishing pad cleaning device 170, it is necessary to remove it.

The polishing device 100 according to the embodiment may further include a water tank 150 and an ultrasonic generator 160.

The water tank 150 is filled with a cleaning solution. After the brush 201 is immersed in the water tank 150, the cleaning liquid is waved by ultrasonic waves generated by the ultrasonic generator 160, so that foreign substance 123 or slurry of the brush 201 may be removed.

Figure 3:
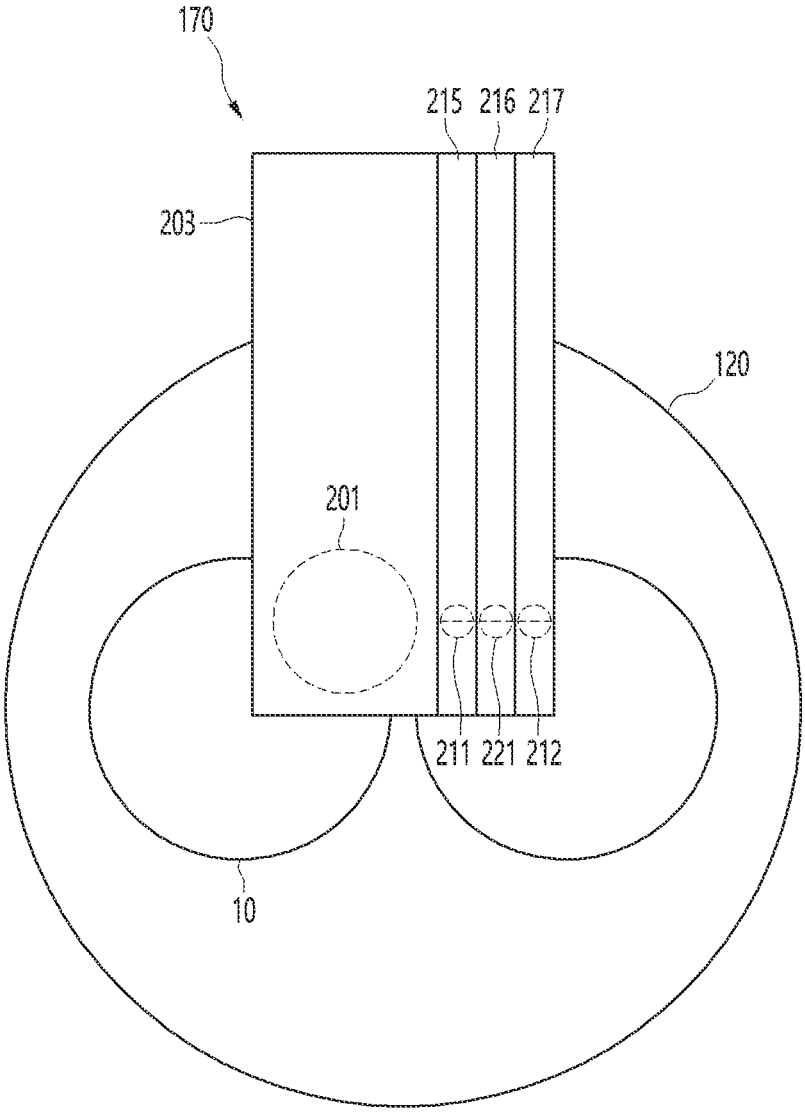
FIG. 3 is a plan view showing an apparatus of cleaning a polishing pad according to the first embodiment.

The water tank 150 is provided on one side of the platen 110, and is configured to store a cleaning liquid that can contain the brush 201 provided in the brush arm (203 in FIG. 3). The water tank 150 is made of quartz material through which ultrasonic waves can be transmitted. For example, the water tank 150 may have an opening with an open upper side and a flat inner bottom surface.

At this time, a supply flow path (not shown) for continuously supplying the cleaning liquid to the water tank 150 side is provided, and the cleaning liquid contained in the water tank 150 is configured to overflow.

The ultrasonic generator 160 is provided under the water tank 150 and is configured to generate ultrasonic waves toward the brush 201 contained in the water tank 150.

According to an embodiment, the ultrasonic generator 160 may be configured in the form of a plurality of modules arranged at predetermined intervals along the horizontal direction, but is not limited thereto.

The operation of the polishing device 100 according to the embodiment configured as described above will be described.

First, the polishing pad 120 is adhered to the upper side of the platen 110 and the wafer 10 may be adsorbed to the lower side of the polishing head 130. Thereafter, the polishing process may be performed as the wafer 10 is rotated while being pressed against the surface of the polishing pad 120 by the polishing head 130 and at the same time, the slurry is supplied by the slurry spray nozzle 140.

Figure 4:
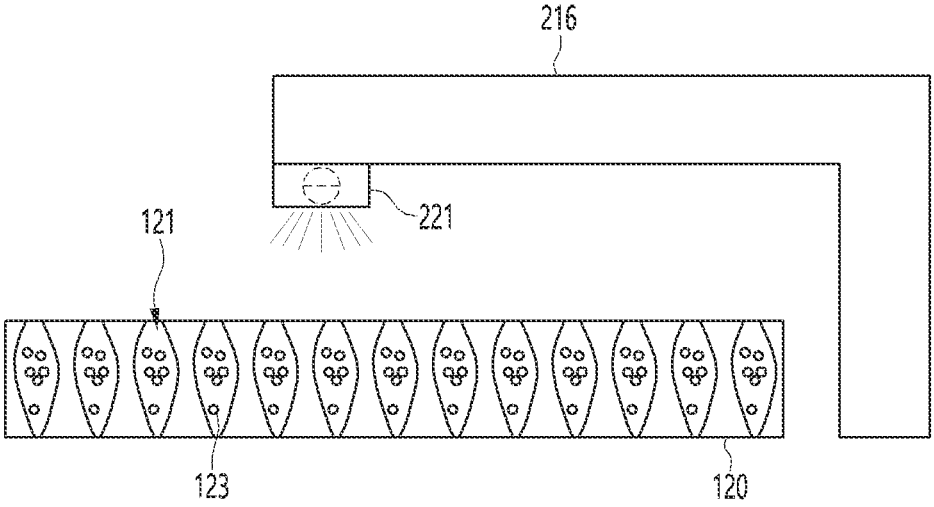
FIG. 4 is a side view showing an apparatus of cleaning a polishing pad according to the first embodiment.

When such a polishing process is repeatedly performed, various foreign substances 123 are accumulated on the surface of the polishing pad 120 as shown in FIG. 4.

A cleaning process of the polishing pad 120 is performed to remove the foreign substance 123 accumulated on the polishing pad 120. A high-speed high-pressure liquid is sprayed from the apparatus of cleaning a polishing pad 170 of the embodiment, and the surface of the polishing pad 120 is dressed while the brush 201 moves horizontally while pressing the surface of the polishing pad 120, so that the foreign substances 123 accumulated on the polishing pad 120 may be removed.

After the foreign substances 123 is removed from the polishing pad 120, a polishing process for another wafer 10 may be performed.

Meanwhile, the polishing process for the wafer 10 may be performed and a cleaning process for the brush 201 of the apparatus of cleaning a polishing pad 170 may also be performed. That is, after the brush 201 is immersed in the water tank 150, vibration may be generated in the cleaning liquid by ultrasonic waves generated by the ultrasonic generator 160. The foreign substance 123 or slurry remaining in the brush 201 may be more easily removed by the vibration of the cleaning liquid generated as described above.

As described above, the polishing pad 120 on which the foreign substances 123 are accumulated due to the polishing process is removed by the polishing process, and the foreign substances 123 remaining in the brush 201 are removed by the water tank 150 and the ultrasonic generator 160.

Hereinafter, the polishing pad cleaning apparatus 170 of the embodiment will be described in more detail.

Example 1

FIG. 3 is a plan view showing an apparatus of cleaning a polishing pad according to a first embodiment, and FIG. FIG. 4 is a side view showing an apparatus of cleaning a polishing pad according to the first embodiment.

Referring to FIG. 3, the apparatus of cleaning a polishing pad 170 according to the first embodiment may include a first gas nozzle 211 and a liquid nozzle 221.

The first gas nozzle 211 may spray gas onto the pores 121 of the polishing pad 120. The gas can be sprayed at high pressure and high speed. The gas may be, for example, air, but is not limited thereto.

The liquid nozzle 221 may spray a liquid onto the pores 121 of the polishing pad 120. The liquid can be jetted at high pressure and high speed. The liquid may be, for example, DI water, but is not limited thereto.

The liquid nozzle 221 may be disposed adjacent to the first gas nozzle 211. The liquid nozzle 221 can be rotated 360 degrees around a vertical axis perpendicular to the surface of the polishing pad 120 to adjust the spraying direction of the liquid. That is, the liquid nozzle 221 may be rotatable so as to spray in multiple directions.

For example, after the first gas nozzle 211 is operated and gas is sprayed, the liquid nozzle 221 is then operated to spray the liquid.

Figure 6:
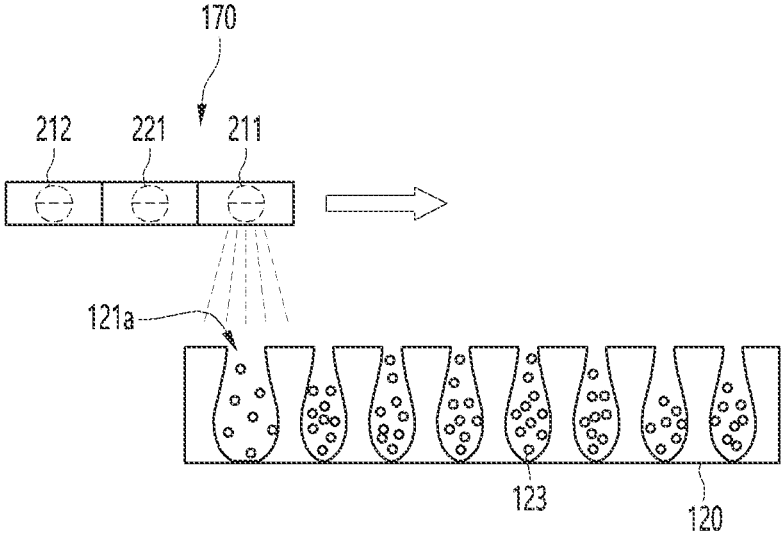
FIG. 6 shows a state in which gas is sprayed from a first gas nozzle in an apparatus of cleaning a polishing pad according to the first embodiment.

Specifically, for example, as shown in FIG. 6, gas may be sprayed from the first gas nozzle 211 to the pores 121*a* of the polishing pad 120 at high pressure and high speed. The volume inside the pores 121*a* of the polishing pad 120, that is, an empty space, may be expanded by the gas sprayed at high pressure and high speed. Accordingly, the inlet of the pore 121*a* of the polishing pad 120 may be expanded.

Figure 7:
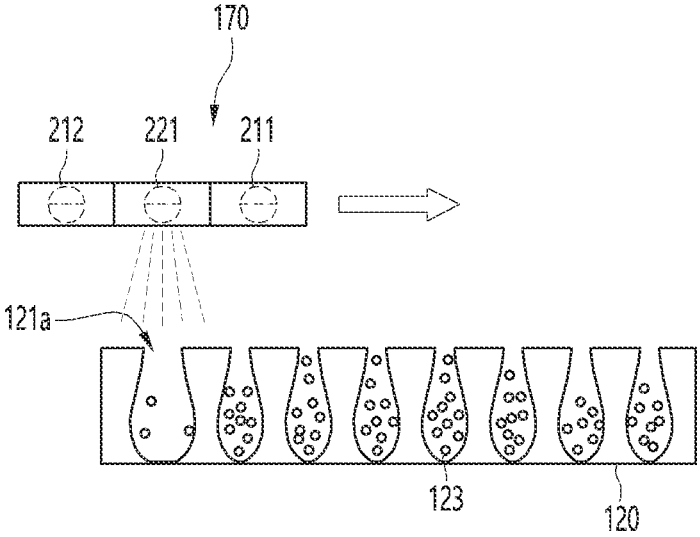
FIG. 7 shows a state in which gas is sprayed from a liquid nozzle in an apparatus of cleaning a polishing pad according to the first embodiment.

Subsequently, as shown in FIG. 7, liquid may be sprayed from the liquid nozzle 221 to the expanded pore 121*a* at high pressure and high speed. It is easy for the liquid sprayed at high pressure and high speed to enter the expanded pore 121*a*, and foreign matter 123 or slurry remaining in the pore 121*a* may be thrown out of the pore 121*a* by the liquid entering the pore 121*a*.

The apparatus of cleaning a polishing pad 170 according to the first embodiment may further include a second gas nozzle 212.

The second gas nozzle 212 may be disposed adjacent to the liquid nozzle 221. For example, the liquid nozzle 221 may be disposed between the first gas nozzle 211 and the second gas nozzle 212. For example, the second gas nozzle 212 may be disposed closer to the second liquid nozzle 221 than the first gas nozzle 211.

For example, a first gas nozzle 211, a liquid nozzle 221, and a second gas nozzle 212 may be disposed along one direction.

Figure 5:
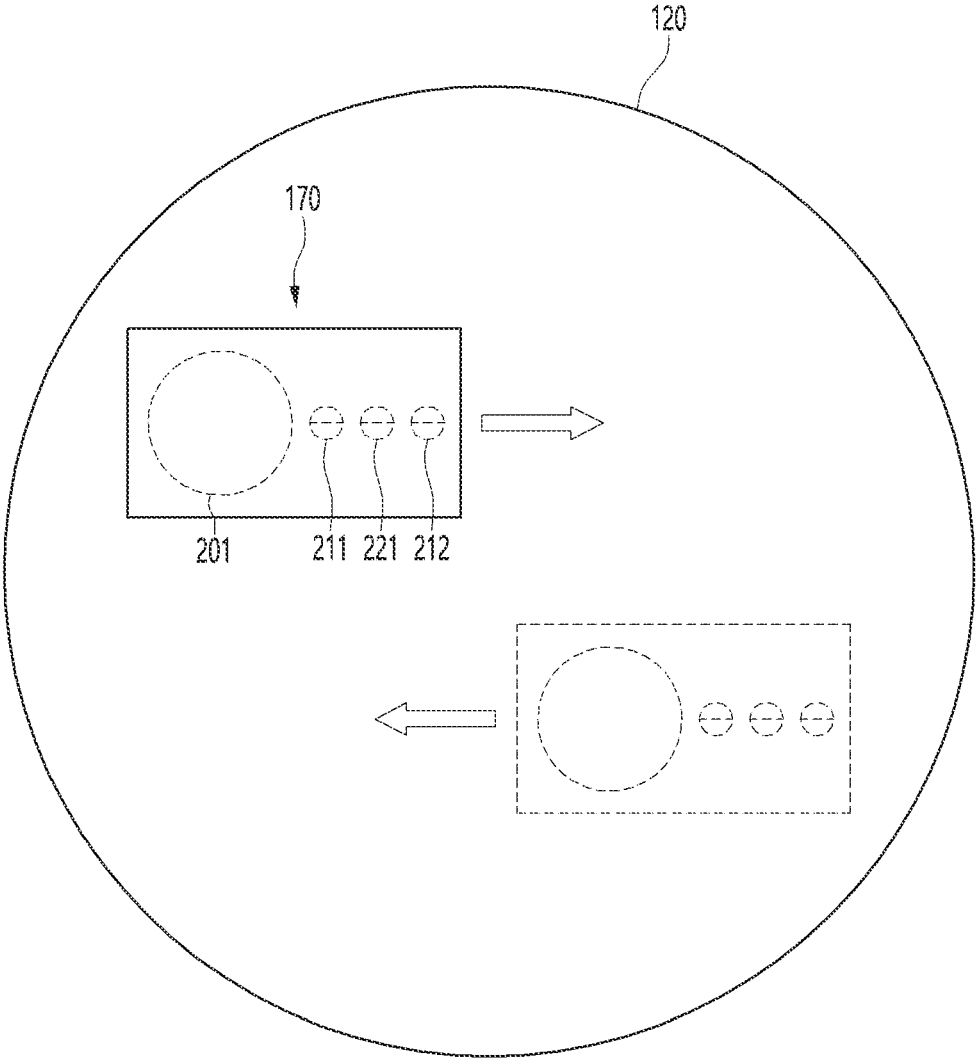
FIG. 5 shows a state in which an apparatus of cleaning a polishing pad according to the first embodiment moves on a wafer.

As shown in FIG. 5, when the polishing pad cleaning device 170 moves from right to left, the first gas nozzle 211 and the liquid nozzle 221 are operated to perform cleaning of the polishing pad 120. That is, the inside of the first pore of the polishing pad 120 is expanded by the gas sprayed from the first gas nozzle 211, and foreign matter 123 or slurry remaining in the expanded first pore may be thrown out of the first pore by the liquid sprayed from the liquid nozzle 221.

When the apparatus of cleaning a polishing pad 170 moves from left to right, the second gas nozzle 212 and the liquid nozzle 221 are operated to perform cleaning of the polishing pad 120. That is, the inside of the second pore of the polishing pad 120 is expanded by the gas sprayed from the second gas nozzle 212, and foreign matter 123 or slurry remaining in the expanded second pore may be thrown out of the second pore by the liquid sprayed from the liquid nozzle 221.

The apparatus of cleaning a polishing pad 170 according to the first embodiment may further include a brush 201.

The brush 201 may dress the surface of the polishing pad 120.

In FIG. 5, the brush 201 is disposed adjacent to the first gas nozzle 211, but is disposed adjacent to the second gas nozzle 212 or is not only disposed on the left side of the first gas nozzle 211 but also the right side of the second gas nozzle 212.

The brush 201 may be supported by the brush arm 203 or may be moved or rotated.

For example, each of the first and second gas nozzles 211 and 212 and the liquid nozzle 221 may be supported by the arms 215 to 217 or may be moved or rotated.

In FIG. 3, the first and second gas nozzles 211 and 212 and the liquid nozzle 221 are shown to be fastened to each of the three arms 215 to 217, but the first and second gas nozzles 211 and 212 and the liquid nozzle 221 are fastened to one arm.

According to the first embodiment, foreign substances 123 or slurry remaining in the pores 121 of the polishing pad 120 can be removed using at least one gas nozzle and the liquid nozzle 221, so that cleanliness of the polishing pad 120 can be improved.

Second Example

Figure 8:
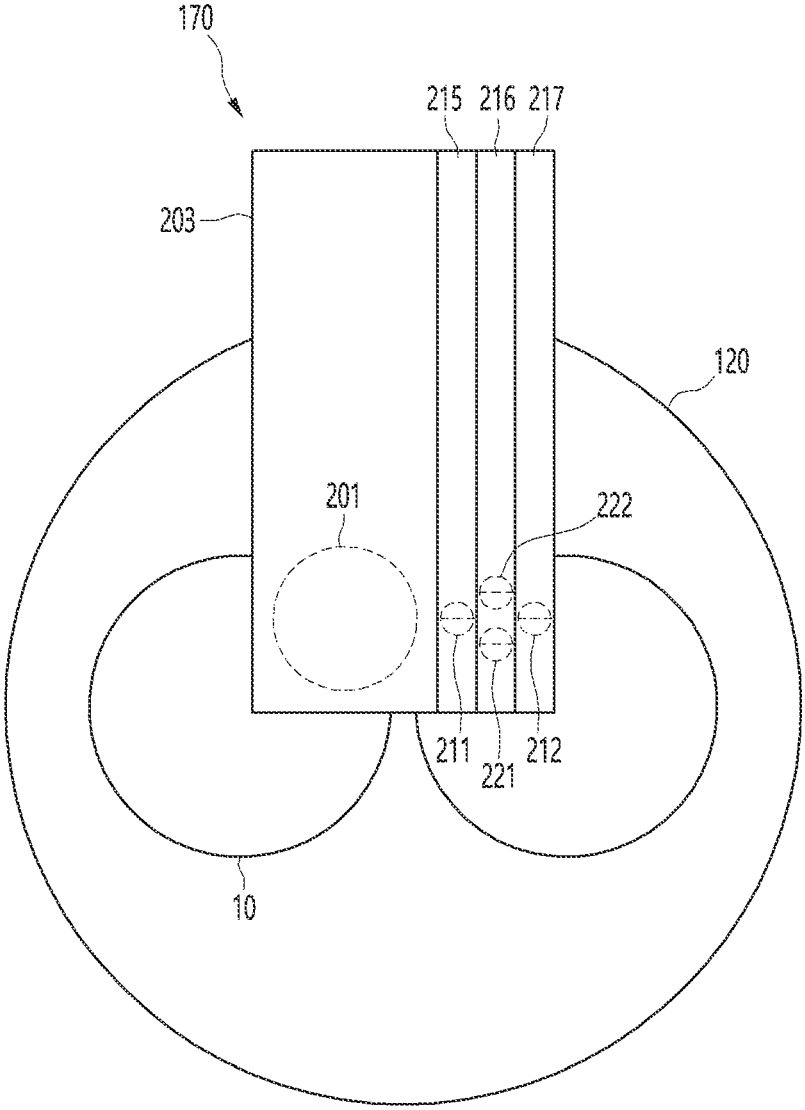
FIG. 8 is a plan view showing an apparatus of cleaning a polishing pad according to a second embodiment.

FIG. 8 is a plan view showing an apparatus of cleaning a polishing pad according to a second embodiment.

The second embodiment is the same as the first embodiment except that one liquid nozzle 222 is added. In the second embodiment, components having the same functions, shapes and/or structures as in the first embodiment are denoted by the same reference numerals, and detailed descriptions are omitted.

Referring to FIG. 8, the apparatus of cleaning a polishing pad 170 according to the second embodiment includes a first gas nozzle 211, a first liquid nozzle 221, a second liquid nozzle 222, and a second gas nozzle 212.

Since the first gas nozzle 211, the second gas nozzle 212, and the first liquid nozzle 221 can be easily understood from the description of the first embodiment, detailed descriptions are omitted.

The second liquid nozzle 222 may spray a liquid onto the pores 121 of the polishing pad 120. The liquid may be, for example, washing water, but is not limited thereto. For example, the liquid used in the second liquid nozzle 222 may be the same as the liquid used in the first liquid nozzle 221, but is not limited thereto.

The second liquid nozzle 222 may be disposed adjacent to the first liquid nozzle 221. The second liquid nozzle 222 can be rotated 360 degrees around a vertical axis perpendicular to the surface of the polishing pad 120 to adjust the spraying direction of the liquid. That is, the second liquid nozzle 222 may be rotatable to spray in multiple directions.

For example, a separation distance between the first liquid nozzle 221 and the second liquid nozzle 222 may be greater than a diameter of an inlet of the pore 121 of the polishing pad 120.

For example, when the first liquid nozzle 221 and the second liquid nozzle 222 are positioned on the pore 121 of the polishing pad 120. The first liquid nozzle 221 may be positioned on the left side above the pore 121 of the polishing pad 120, and the second liquid nozzle 222 may be positioned on the right side above the pore 121 of the polishing pad 120.

A first liquid nozzle 221 and a second liquid nozzle 222 may be disposed between the first gas nozzle 211 and the second gas nozzle 212.

The arrangement direction of the first liquid nozzle 221 and the second liquid nozzle 222 and the arrangement direction of the first gas nozzle 211 and the second gas nozzle 212 may be different. For example, the first gas nozzle 211 and the second gas nozzle 212 are disposed along a first direction, and the first liquid nozzle 221 and the second liquid nozzle 222 are disposed along a second direction perpendicular to the first direction, but is not limited thereto. The first direction may be a moving direction of the polishing pad 120, and the second direction may be a direction perpendicular to the moving direction of the polishing pad 120.

Figure 9:
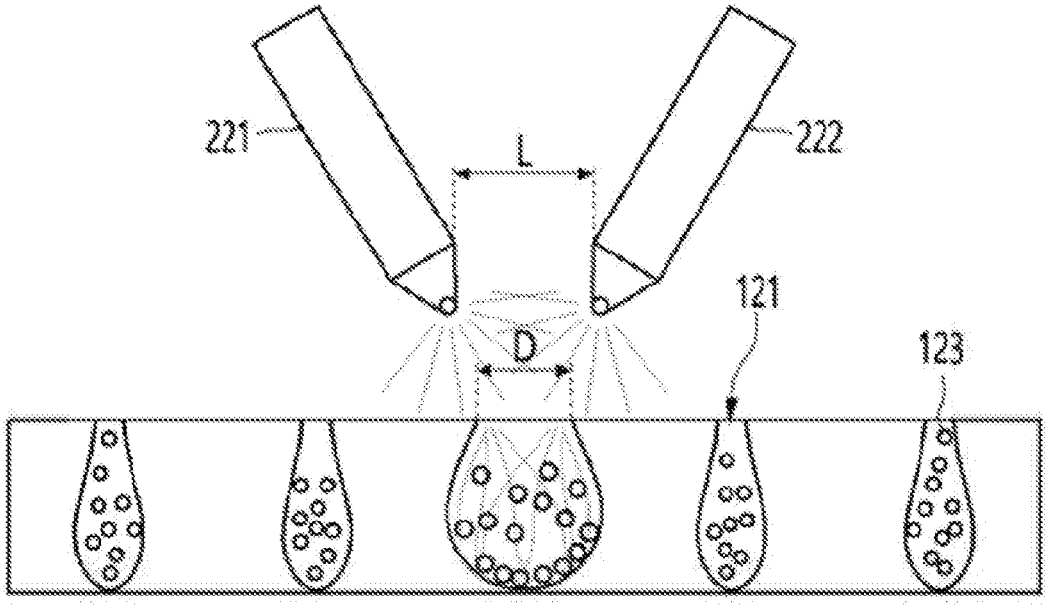
FIG. 9 shows a state of cleaning the polishing pad using the first and second liquid nozzles of FIG. 8.

As shown in FIG. 9, the first liquid nozzle 221 is disposed at a first tilt angle with respect to the polishing pad 120, and the second liquid nozzle 222 is disposed at a second tilt angle with respect to the polishing pad 120. For example, the first tilt angle and the second tilt angle may have the same angle in a vertical line with respect to the pore 121 of the polishing pad 120, but this is not limited thereto.

Accordingly, the first liquid sprayed by the first liquid nozzle 221 may be sprayed at a tilt angle toward the lower right, and the second liquid sprayed by the second liquid nozzle 222 may be sprayed at a tilt angle toward the lower left have.

In this case, the first liquid sprayed by the first liquid nozzle 221 strongly collides with the right inner wall inside the pore 121 of the polishing pad 120 and the second liquid sprayed by the second liquid nozzle 222 strongly collides with the left inner wall inside the pore 121 of the polishing pad 120.

For example, foreign substance 123 or slurry remaining inside the polishing pad 120 may be thrown out of the pores 121 of the polishing pad 120 due to collision. Accordingly, foreign substance 123 or slurry remaining in the pore 121 of the polishing pad 120 can be easily removed by the first and second liquid nozzles 221 and 222.

Figure 10A:
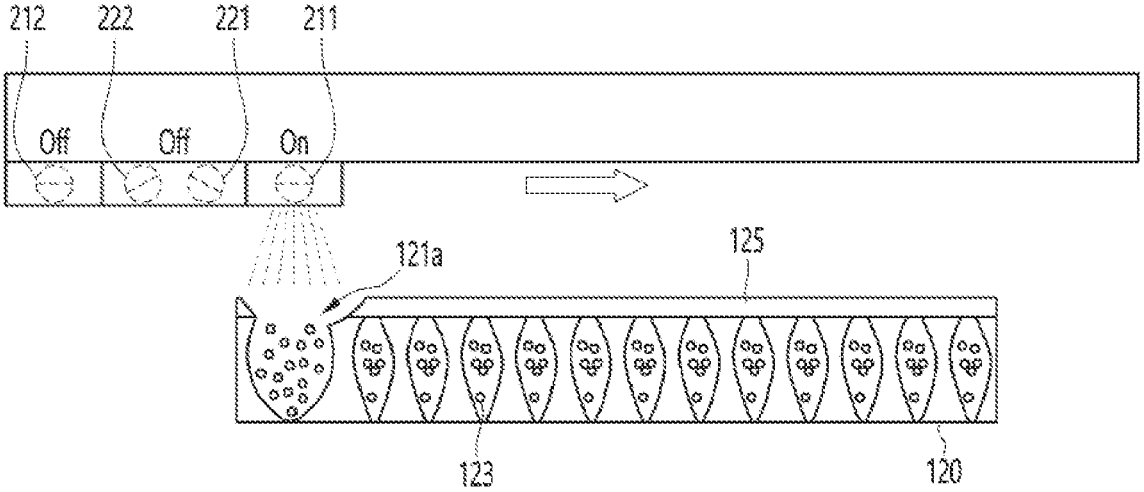
FIG. 10A and FIG. 10B show a state in which an apparatus of cleaning a polishing pad moves in the first direction to clean the polishing pad.
Figure 10B:
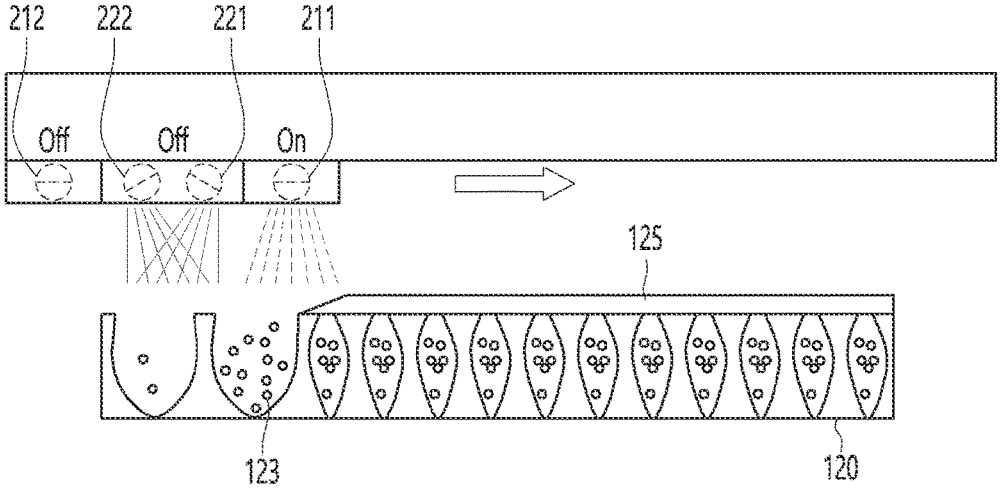

FIG. 10A and FIG. 10B show a state in which the apparatus of cleaning a polishing pad moves in the first direction to clean the polishing pad.

In FIG. 5, when the polishing pad cleaning device 170 moves from right to left, as shown in FIG. 10A, the inside of the pore 121*a* of the polishing pad 120 may be expanded by the gas sprayed from the first gas nozzle 211. When the polishing pad cleaning device 170 moves further to the left, foreign matter 123 or slurry remaining in the expanded pore 121*a* may be thrown out of the pore 121*a* by the liquid sprayed in the diagonal direction from each of the first and second liquid nozzles 221 and 222.

Figure 11A:
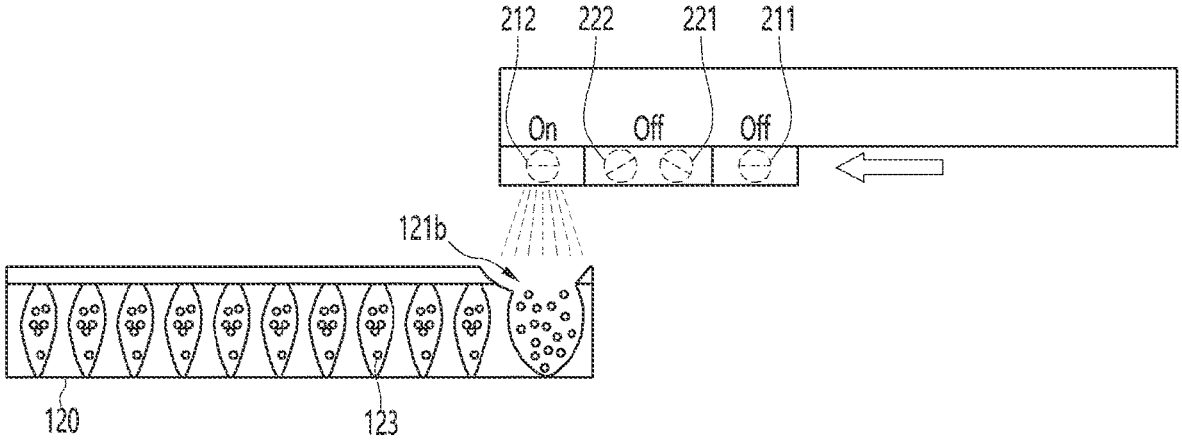
FIG. 11A and FIG. 11B show a state in which an apparatus of cleaning a polishing pad moves in the second direction to clean the polishing pad.
Figure 11B:
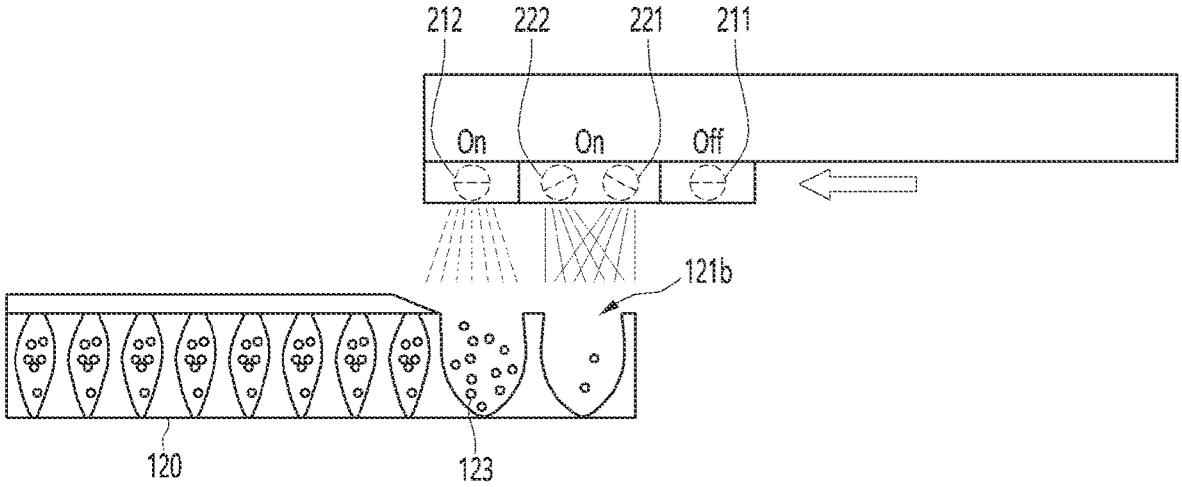

FIG. 11A and FIG. 11B show a state in which the apparatus of cleaning a polishing pad moves in the second direction to clean the polishing pad.

In FIG. 5, when the apparatus of cleaning a polishing pad 170 moves from left to right, the inside of the pore 121*b* of the polishing pad 120 may be expanded by the gas sprayed from the second gas nozzle 212. When the polishing pad cleaning device 170 moves further to the right, foreign substances 123 or slurry remaining in the expanded pore 121*b* may be thrown out of the pore 121*b* by the liquid sprayed from each of the first and second liquid nozzles 221 and 222 in the main direction.

According to the second embodiment, the first liquid nozzle 221 and the second liquid nozzle 222 are disposed in a diagonal direction so as to face each other, and are sprayed from each of the first liquid nozzle 221 and the second liquid nozzle 222. The sprayed liquid collides with the inside of the pore 121 of the polishing pad 120 in a diagonal direction so that the foreign substance 123 or the slurry in the pore 121 of the polishing pad 120 may be more completely removed.

In FIGS. 10A, 10B, 11A, and 1 IB, a DI water layer 125 on the surface of the polishing pad may be removed by gas sprayed from the gas nozzles 211 and 212.

Third Example

Figure 12:
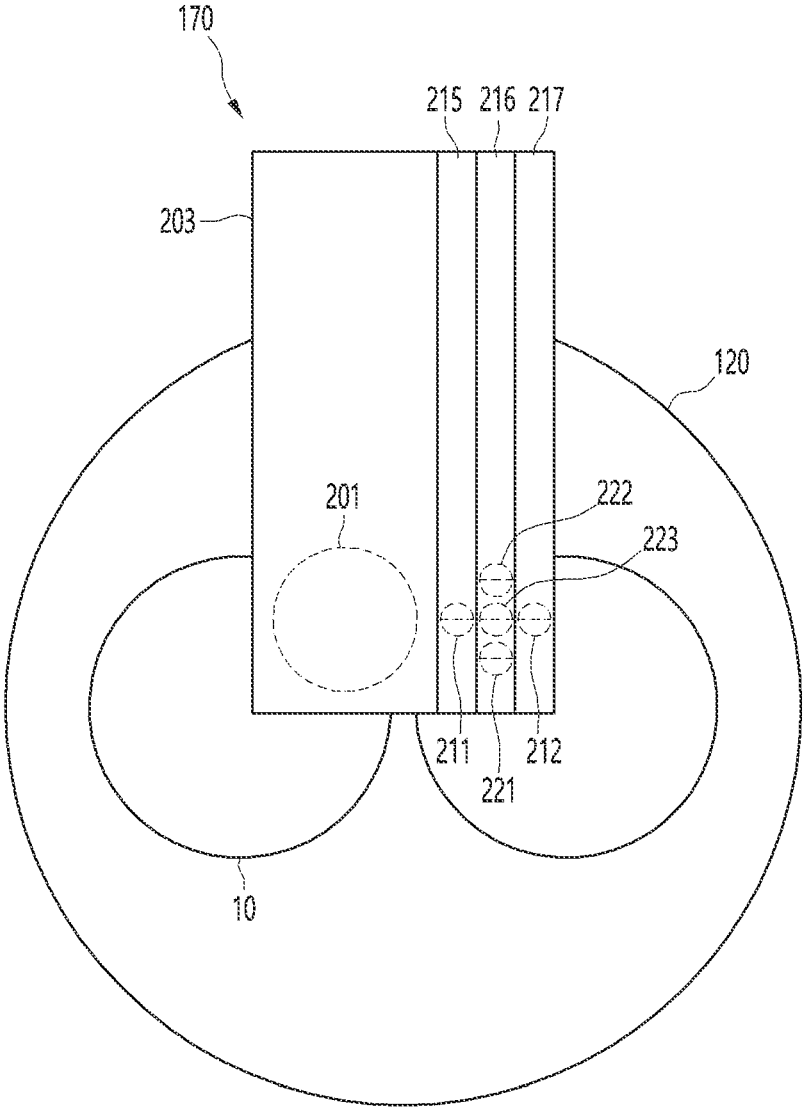
FIG. 12 is a plan view showing an apparatus of cleaning a polishing pad according to a third embodiment.

FIG. 12 is a plan view showing an apparatus of cleaning a polishing pad according to a third embodiment.

The third embodiment is the same as the first embodiment except that two liquid nozzles are added. In the third embodiment, components having the same functions, shapes and/or structures as in the first embodiment are denoted by the same reference numerals, and detailed descriptions are omitted.

Referring to FIG. 12, the apparatus of cleaning a polishing pad 170 according to the third embodiment includes a first gas nozzle 211, a first liquid nozzle 221, a second liquid nozzle 222, and a third liquid nozzle 223, and a second gas nozzle 212.

Since the first gas nozzle 211, the second gas nozzle 212, the first liquid nozzle 221, and the second liquid nozzle 222 can be easily understood from the description of the second embodiment, a detailed description will be omitted.

For example, the first gas nozzle 211, the third liquid nozzle 223, and the second gas nozzle 212 may be arranged in a line along the first direction. For example, the first liquid nozzle 221, the third liquid nozzle 223, and the second liquid nozzle 222 may be arranged in a line along the second direction. The first direction may be a moving direction of the polishing pad 120, and the second direction may be a direction perpendicular to the moving direction of the polishing pad 120. The first direction and the second direction may be perpendicular to each other, but are not limited thereto. For example, the third liquid nozzle 223 may be disposed at an intersection of the first direction and the second direction.

For example, the second gas nozzle 212 may be disposed closer to one of the first to third liquid nozzles 221, 222, 223 than the first gas nozzle 211.

The third liquid nozzle 223 may spray a liquid onto the pores 121 of the polishing pad 120. The liquid may be, for example, washing water, but is not limited thereto. For example, the liquid used in the third liquid nozzle 223 may be the same as the liquid used in the first liquid nozzle 221 and/or the second liquid nozzle 222, but is not limited thereto.

The third liquid nozzle 223 may be disposed between the first liquid nozzle 221 and the second liquid nozzle 222. The third liquid nozzle 223 may be disposed between the first gas nozzle 211 and the second gas nozzle 212.

The third liquid nozzle 223 can be rotated 360 degrees around a vertical axis perpendicular to the surface of the polishing pad 120 to adjust the spraying direction of the liquid. That is, the third liquid nozzle 223 may be rotatable to spray in multiple directions.

The first to third liquid nozzles 221 to 223 may be disposed between the first gas nozzle 211 and the second gas nozzle 212.

The arrangement directions of the first to third liquid nozzles 221 to 223 and the arrangement directions of the first gas nozzle 211 and the second gas nozzle 212 may be different. For example, the first gas nozzle 211 and the second gas nozzle 212 are disposed along a first direction, and the first to third liquid nozzles 221 to 223 are disposed along a second direction perpendicular to the first direction, but is not limited thereto.

Three liquid nozzles are arranged in FIG. 12, but more liquid nozzles may be provided.

Figure 13:
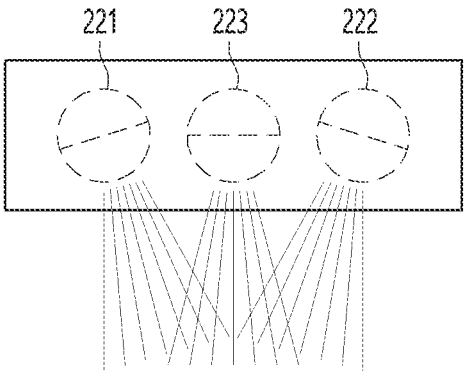
FIG. 13 shows liquid spraying directions in each of the first to third cleaning devices of FIG. 12.

For example, a separation distance between the first liquid nozzle 221 and the second liquid nozzle 222 may be greater than a diameter of an inlet of the pore 121 of the polishing pad 120. In this case, as shown in FIG. 13, the first liquid nozzle 221 is disposed at a first tilt angle with respect to the polishing pad 120, the second liquid nozzle 222 is disposed at a second tilt angle with respect to the polishing pad 120, and the third liquid nozzle 223 disposed between the first liquid nozzle 221 and the second liquid nozzle 222 is disposed vertically with respect to the polishing pad. For example, the first tilt angle and the second tilt angle may have the same angle in a vertical line with respect to the pore 121 of the polishing pad 120, but this is not limited thereto.

Accordingly, the first liquid sprayed by the first liquid nozzle 221 is sprayed at a tilt angle toward the lower right, the second liquid sprayed by the second liquid nozzle 222 is sprayed at a tilt angle toward the lower left, and the third liquid sprayed by the third liquid nozzle 223 is sprayed vertically with respect to the polishing pad.

In this case, the first liquid sprayed by the first liquid nozzle 221 strongly collides with the right inner wall inside the pore 121 of the polishing pad 120 and the second liquid sprayed by the second liquid nozzle 222 strongly collides with the left inner wall of the pore 121 of the polishing pad 120, and the third liquid sprayed by the third liquid nozzle 223 strongly collides with the bottom of the pore 121 of the polishing pad 120.

For example, foreign substance 123 or slurry remaining inside the polishing pad 120 may be thrown out of the pores 121 of the polishing pad 120 due to collision. Accordingly, foreign substance 123 or slurry remaining in the pore 121 of the polishing pad 120 can be easily removed by the first to third liquid nozzles 221 to 223.

According to the third embodiment, foreign matter 123 or slurry remaining inside the pores of the polishing pad 120 is more completely removed, through the first and second liquid nozzles 221 and 222 disposed to have a tilt angle with respect to the polishing pad and a third liquid nozzle 223 disposed vertically with respect to the polishing pad 120 between the first and second liquid nozzles 221 and 222. Thus, the cleanliness of the polishing pad can be improved.

Figure 14:
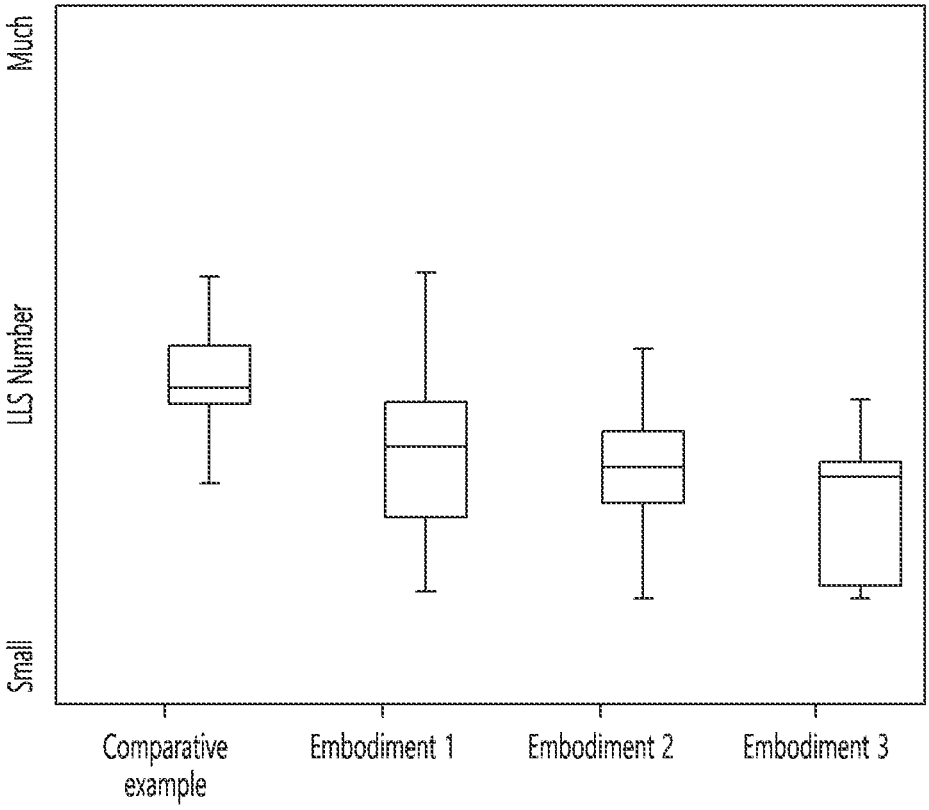
FIG. 14 shows LLS levels in a comparative example and the embodiment.

FIG. 14 shows LLS levels in a comparative example and the embodiment.

As shown in FIG. 14, compared to the comparative example, the number of LLSs in all of Embodiment 1, Embodiment 2, and Embodiment 3 are small, which may mean that particles or slurries are reduced. Accordingly, it can be seen that the cleanliness of the polishing pad 120 in all of Embodiments 1, 2 and 3 is improved compared to the comparative example.

The above detailed description should not be construed as limiting in all respects and should be considered as illustrative. The scope of the embodiments should be determined by reasonable interpretation of the accompanying claims, and all changes within the equivalent scope of the embodiments are included in the scope of the embodiments.

What is claimed is:

1. An apparatus of cleaning a polishing pad having pores provided on a surface thereof, comprising:

first to fourth arms configured to contact with each other, the third arm being between the first arm and the second arm;

a first gas nozzle configured to be fastened to a lower side of the first arm and configured to spray a first gas onto pores of the polishing pad;

a first liquid nozzle for spraying a first liquid to the pores of the polishing pad;

a second liquid nozzle near to the first liquid nozzle to spray a second liquid onto the pores of the polishing pad;

a third liquid nozzle disposed between the first liquid nozzle and the second liquid nozzle to spray a third liquid to the pores of the polishing pad;

a second gas nozzle configured to be fastened to a lower side of the second arm and configured to spray a second gas to the pores of the polishing pad;

a brush configured to be provided on a lower side of the fourth arm and configured to dress the surface of the polishing pad; and at least one arm for supporting the first gas nozzle, the second gas nozzle, the first liquid nozzle, the second liquid nozzle and the third liquid nozzle, wherein the first liquid nozzle, the second liquid nozzle and the third liquid nozzle are configured to be fastened to a lower side of the third arm, wherein the volume inside the respective pores is expanded by the first gas or the second gas to expand an inlet of the respective pores, and the first to third liquid are sprayed toward the inside the respective pores through the expanded inlet of the respective pores, wherein the first liquid nozzle and the second liquid nozzle are disposed in a diagonal direction to face each other so that the first liquid and the second liquid are configured to collide with the inside of each of the pores in the diagonal direction, wherein the first gas nozzle, the third liquid nozzle, and the second gas nozzle are arranged in a line along a first direction, and the first liquid nozzle, the third liquid nozzle, and the second liquid nozzle are arranged in a line along a second direction perpendicular to the first direction, the third liquid nozzle being located at crossing of the first direction and the second direction, wherein the third liquid nozzle is surrounded by the first gas nozzle, the first liquid nozzle, the second gas nozzle and the second liquid nozzle, and the first gas nozzle and the second gas nozzle are disposed on opposite sides of the third liquid nozzle, wherein the first to third liquid nozzles are disposed between the first gas nozzle and the second gas nozzle, and when the at least one arm moves from a first side of the polishing pad to a second side of the polishing pad, the second gas nozzle and the first to third liquid nozzles are operated to perform cleaning of the polishing pad, and when the at least one arm moves to the second side of the polishing pad to the first side of the polishing pad, the first gas nozzle and the first to third liquid nozzles are operated to perform cleaning of the polishing pad.

2. The apparatus of claim 1, wherein a separation distance between the first liquid nozzle and the second liquid nozzle is greater than a diameter of an inlet of the pore of the polishing pad.

3. The apparatus of claim 1, wherein each of the first to third liquid nozzles is rotatable around a vertical axis perpendicular to the surface of the polishing pad to spray in multiple directions.

4. The apparatus of claim 3, wherein the first liquid nozzle is disposed at a first tilt angle with respect to the polishing pad, the second liquid nozzle is disposed at a second tilt angle with respect to the polishing pad, and the third liquid nozzle is disposed vertically with respect to the polishing pad.

5. The apparatus of claim 1, wherein the second gas nozzle is disposed closer to one of the first to third liquid nozzles than the first gas nozzle.

6. The apparatus of claim 1, wherein the brush is disposed adjacent to at least one gas nozzle of the first gas nozzle and the second gas nozzle.

7. The apparatus of claim 1, wherein the first and second gas are air, the first to third liquid are washing water.

8. The apparatus of claim 1, wherein each of the first gas nozzle, the first liquid nozzle, the second gas nozzle and the second liquid nozzle are located at each of vertices of the rhombus.

9. A polishing device, comprising:

a platen;

a polishing pad disposed on the platen;

a polishing head positioned on the polishing pad, adsorbed to a lower portion of the polishing pad and pressed against the polishing pad;

a slurry spray nozzle spraying the slurry onto the polishing pad; and an apparatus of cleaning a polishing pad having pores provided on a surface thereof, wherein the apparatus of cleaning a polishing pad comprises:

first to fourth arms configured to contact with each other, the third arm being between the first arm and the second arm;

a first gas nozzle configured to be fastened to a lower side of the first arm and configured to spray a first gas onto pores of the polishing pad; a first liquid nozzle for spraying a first liquid to the pores of the polishing pad; a second liquid nozzle near to the first liquid nozzle to spray a second liquid onto the pores of the polishing pad; a third liquid nozzle disposed between the first liquid nozzle and the second liquid nozzle to spray a third liquid to the pores of the polishing pad; a second gas nozzle configured to be fastened to a lower side of the second arm and configured to spray a second gas to the pores of the polishing pad; a brush configured to be provided on a lower side of the fourth arm and configured to dress the surface of the polishing pad; and at least one arm for supporting the first gas nozzle, the second gas nozzle, the first liquid nozzle, the second liquid nozzle and the third liquid nozzle, wherein the first liquid nozzle, the second liquid nozzle and the third liquid nozzle are configured to be fastened to a lower side of the third arm, wherein the volume inside the respective pores is expanded by the first gas or the second gas to expand an inlet of the respective pores, and the first to third liquid are sprayed toward the inside the respective pores through the expanded inlet of the respective pores, wherein the first liquid nozzle and the second liquid nozzle are disposed in a diagonal direction to face each other so that the first liquid and the second liquid are configured to collide with the inside of each of the pores in the diagonal direction, wherein the first gas nozzle, the third liquid nozzle, and the second gas nozzle are arranged in a line along a first direction, and the first liquid nozzle, the third liquid nozzle, and the second liquid nozzle are arranged in a line along a second direction perpendicular to the first direction, the third liquid nozzle being located at crossing of the first direction and the second direction, wherein the third liquid nozzle is surrounded by the first gas nozzle, the first liquid nozzle, the second gas nozzle and the second liquid nozzle, and the first gas nozzle and the second gas nozzle are disposed on opposite sides of the third liquid nozzle, wherein the first to third liquid nozzles are disposed between the first gas nozzle and the second gas nozzle, and when the at least one arm moves from a first side of the polishing pad to a second side of the polishing pad, the second gas nozzle and the first to third liquid nozzles are operated to perform cleaning of the polishing pad, and when the at least one arm moves to the second side of the polishing pad to the first side of the polishing pad, the first gas nozzle and the first to third liquid nozzles are operated to perform cleaning of the polishing pad.

10. The polishing device of claim 9, wherein each of the first gas nozzle, the first liquid nozzle, the second gas nozzle and the second liquid nozzle are located at each of vertices of the rhombus.

* * * * *